US009068291B2

(12) United States Patent
Waite et al.

(10) Patent No.: US 9,068,291 B2
(45) Date of Patent: Jun. 30, 2015

(54) SYSTEM AND METHOD FOR CONDITIONING A HARDWOOD PULP LIQUID HYDROLYSATE

(71) Applicants: Red Shield Acquisition, LLC, Old Town, ME (US); University of Maine System Board of Trustees, Bangor, ME (US)

(72) Inventors: Darrell Waite, Bangor, ME (US); Richard Arnold, Milford, ME (US); James St. Pierre, Milford, ME (US); Hemant P. Pendse, Orono, ME (US); William H. Ceckler, Hancock, ME (US)

(73) Assignees: Red Shield Acquisition, LLC, Old Town, ME (US); University of Maine System Board of Trustees, Bangor, ME (US)

( * ) Notice: Subject to any disclaimer, the term of this patent is extended or adjusted under 35 U.S.C. 154(b) by 0 days.

(21) Appl. No.: 14/079,049

(22) Filed: Nov. 13, 2013

(65) Prior Publication Data

US 2014/0060520 A1 Mar. 6, 2014

Related U.S. Application Data

(62) Division of application No. 13/187,818, filed on Jul. 21, 2011, now Pat. No. 8,608,970.

(60) Provisional application No. 61/367,164, filed on Jul. 23, 2010.

(51) Int. Cl.

| | |
|---|---|
| ***D21C 11/00*** | (2006.01) |
| ***C13K 13/00*** | (2006.01) |
| ***C13K 1/02*** | (2006.01) |
| *D21C 11/10* | (2006.01) |

(52) U.S. Cl.

CPC ..... *D21C 11/0007* (2013.01); *C13K 1/02* (2013.01); *C13K 13/00* (2013.01); *D21C 11/0042* (2013.01); *D21C 11/10* (2013.01)

(58) Field of Classification Search

CPC ..... D21C 11/0007; D21C 11/0042; D21C 11/10; C13K 1/02; C13K 13/00

See application file for complete search history.

(56) References Cited

U.S. PATENT DOCUMENTS 5,411,594 A * 5/1995 Brelsford ..... 127/37
6,409,841 B1 * 6/2002 Lombard ..... 127/37

OTHER PUBLICATIONS

Palmqvist et al., Fermentation of lignocellulosic hydrolysates. I: Inhibition and detoxification, 2000, Elsevier, Bioresource Technology, 744, pp. 17-24.*

Mao et al., Technical economic evaluation of a hardwood biorefinery using the "near-neutral" hemicellulose pre-extraction process, Jun. 2008, Journal of Biobased Materials and Bioenergy, vol. 2, No. 2, pp. 177-185.*

* cited by examiner

*Primary Examiner* — David C Mellon

(74) *Attorney, Agent, or Firm* — Hayes Soloway PC

(57) ABSTRACT

A system and method for hardwood pulp liquid hydrolysate conditioning includes a first evaporator receives a hardwood mix extract and outputting a quantity of vapor and extract. A hydrolysis unit receives the extract, hydrolyzes and outputs to a lignin separation device, which separates and recovers a quantity of lignin. A neutralization device receives extract from the lignin separation device and a neutralizing agent, producing a mixture of solid precipitate and a fifth extract. The solid precipitate is removed from the fifth extract. A second evaporator removes a quantity of acid from the fifth extract in a vapor form. This vapor may be recycled to improve total acid recovery or discarded. A desalination device receives the diluted extract, separates out some of the acid and salt and outputs a desalinated solution.

15 Claims, 3 Drawing Sheets

SYSTEM AND METHOD FOR CONDITIONING A HARDWOOD PULP LIQUID HYDROLYSATE

CROSS REFERENCE TO RELATED APPLICATION

This application is a divisional application of co-pending application Ser. No. 13/187,818, now U.S. Pat. No. 8,608,970, entitled "Hardwood Raw Liquid Extraction System and Process," filed Jul. 21, 2011. This application claims benefit of U.S. Provisional Application Ser. No. 61/367,164 entitled, "Hardwood Raw Liquid Extraction System and Process," filed Jul. 23, 2010, the entire disclosure of which is incorporated herein by reference.

STATEMENT REGARDING FEDERALLY SPONSORED RESEARCH OR DEVELOPMENT

This invention was made with Government support under contract number DE-EE0003364 awarded by the Department of Energy. The Government has certain rights in the invention.

FIELD OF THE DISCLOSURE

The present disclosure is generally related to wood-to-biofuel systems and processes and more particularly is related to a system and process for conditioning a hardwood pulp liquid hydrolysate.

BACKGROUND OF THE DISCLOSURE

The extraction of various substances, such as raw liquid extract, from a solid hardwood or hardwood pulp is a common and necessary process when making paper or other cellulose-based materials. Hardwood naturally contains substances useful for processing into bio-fuel byproducts. However, while hardwood is regularly processed for making paper or other cellulose-based materials, it has never been efficiently processed into bio-fuel byproducts with commercial success. Acetone, butanol, and ethanol, as an example, can be processed from hardwoods. However, to date, the processes developed to date have been too costly to pursue commercially. One of the process difficulties contributing to the lack of commercial success is the difficulty in separating lignin from hardwood extract in a commercially viable manner.

Thus, an unaddressed need exists in the industry to provide a system and method for conditioning raw wood extract to create products of interest such as sugars suitable for fermentation and organic acids.

SUMMARY OF THE DISCLOSURE

Embodiments of the present disclosure provide a system and method for hardwood pulp liquid hydrolysate conditioning. Briefly described, in architecture, one embodiment of the system, among others, can be implemented as follows. A first evaporator receives a first extract derived from a quantity of hardwood mix and outputs a quantity of vapor and a quantity of second extract. A hydrolysis unit is positioned to receive the second extract and output a third extract. At least one lignin separation device is positioned to receive the third extract from the hydrolysis unit, wherein the lignin separation device separates and recovers a quantity of lignin. A neutralization device positioned to receive a fourth extract from the at least one lignin separation device, the neutralization device contains a neutralizing agent. The neutralization device neutralizes the fourth extract, whereby a combination of the fourth extract and the neutralizing agent produces a mixture of solid precipitate and a fifth extract. A precipitate removal device positioned to receive the mixture of solid precipitate and the fifth extract from the neutralization device removes the solid precipitate from the fifth extract. An output of the precipitate removal device is fifth extract.

A second evaporator is positioned to receive the fifth extract and removes a quantity of acid and water from the fifth extract in a vapor form. The second evaporator has a first output for the quantity of acid and water vapor and a second output for the sixth extract. The second evaporator operates between a pH 2 and 4. A third evaporator is positioned to receive the sixth extract through a first input and a quantity of water through a second input. The third evaporator may be connected to the first evaporator and may output to the first evaporator a quantity of residual acid in vapor form from the seventh extract and separately outputs a seventh extract. A desalination device is positioned to receive either the sixth extract from the second evaporator or the seventh extract from the third evaporator. The desalination device outputs an acid and salt-rich liquid and a desalinated solution.

The present disclosure can also be viewed as providing methods for hardwood pulp liquid hydrolysate conditioning. In this regard, one embodiment of such a method, among others, can be broadly summarized by the following steps: receiving a first extract derived from a quantity of hardwood mix into a first evaporator and outputting a quantity of vapor and a second extract; hydrolyzing the second extract and outputting from the second extract a quantity of sugars in a third extract; separating and recovering a quantity of lignin from the third extract and outputting a resulting fourth extract; neutralizing the fourth extract, thereby forming a quantity of solid precipitate and fifth extract; separating the quantity of solid precipitate from the fifth extract; removing a quantity of acid from the fifth extract within a second evaporator, outputting a quantity of vapor having the quantity acid and outputting a sixth extract; and reducing a quantity of salt, heavy metals, and residual acid and lignin within the seventh extract and outputting an acid and salt-rich liquid solution and a desalinated solution.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
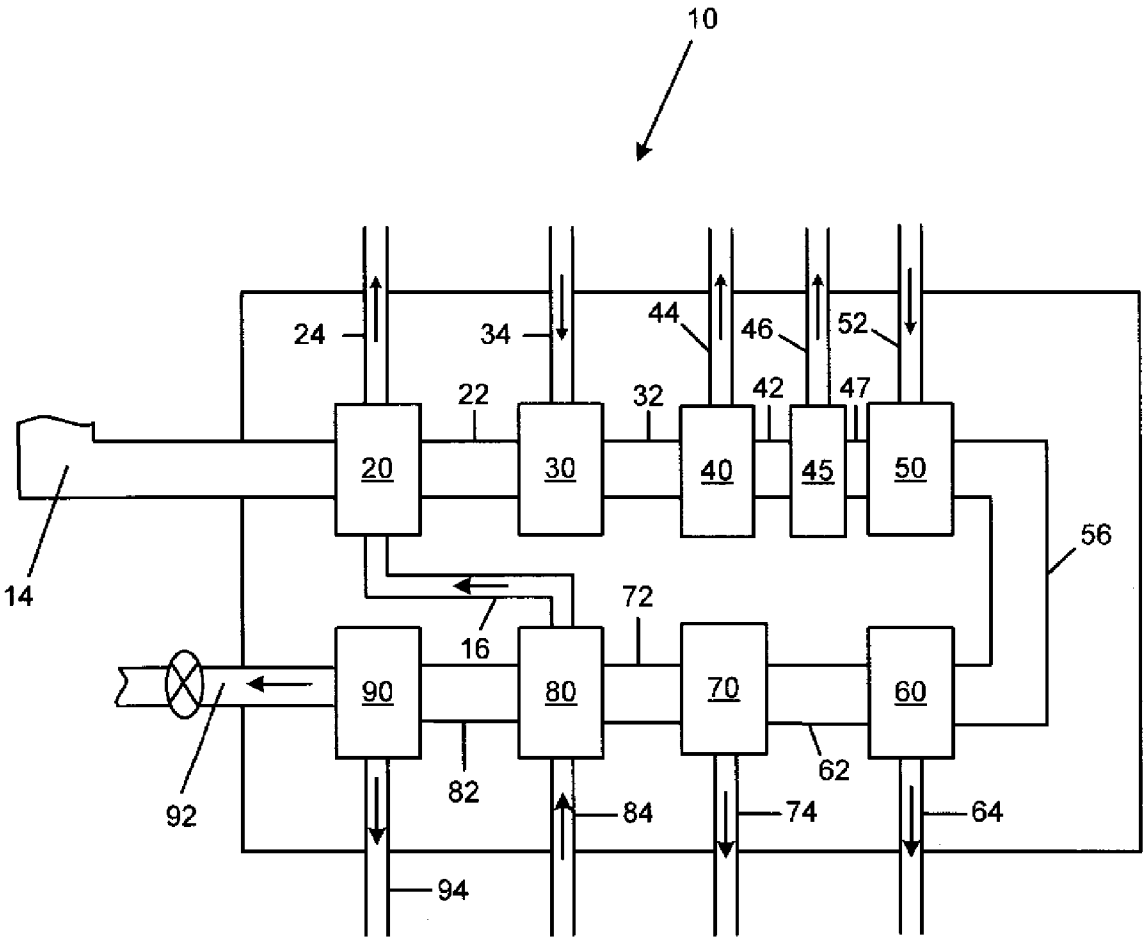
FIG. 1 is a schematic illustration of a continuous hardwood raw liquid extraction system, in accordance with a first exemplary embodiment of the present disclosure.

FIG. 1 is a schematic illustration of a hardwood pulp liquid hydrolysate conditioning system 10, in accordance with a first exemplary embodiment of the present disclosure. The hardwood pulp liquid hydrolysate conditioning system 10, hereinafter simply referred to as the 'system' 10, may be used to extract a liquid solution from a hardwood substance, such as a solid hardwood mix. The system 10 may include a series of devices used to process hardwood mix to carry out the extraction of the liquid solution. As will be discussed herein, the system 10 may include three states of evaporation, a hydrolysis element and an electro dialysis element, chilling elements, among other elements and steps, wherein volatile organic acids, such as acetic and formic acids and monomeric sugar solutions, may be produced. These volatile organic acids may be suitable for further processing to various qualities and concentrations of commercial products. Monomeric sugar solutions may be suitable for fermentation or chemical alteration to other organic compounds. Some of the devices are configured to operate at predetermined conditions, including predetermined temperatures and pH levels and solution concentrations for predetermined periods of time.

The system 10 may include at least eight devices to condition the liquid solution from the solid hardwood mix. The system 10 includes devices, systems, and components that are arranged in specific and unique sequences, as discussed herein. Accordingly, although variations within the system 10 may exist, optimal technical and economic viability of the system 10 may be achieved when the system 10 is operated in accordance to the conditions disclosed herein.

The first device may be a first evaporator 20, which may receive a first extract derived from a quantity of solid hardwood mix through a first input conduit 14. The first evaporator 20 may also receive a quantity of vapor through a feedback feed 16, discussed further herein. The first evaporator 20 may be operated between a pH 6 and 8 with a concentration factor of 4×-8×. The evaporation may help in reducing a downstream hydraulic load to approximately 10%-25% of the feed volume with minimal release of acid into the vapor phase. This may significantly reduce the size of units downstream of the first evaporator 20, thereby resulting in a lower capital expense and lower operating costs of the system 10. The system 10 may allow for the utilization of sensible energy from the extract solution, which may provide a high fraction of the heat of vaporization required to evaporate the solution in order to minimize steam demand. Accordingly, the first evaporator 20 may receive the first extract derived from a quantity of hardwood mix chips and may output a quantity of vapor comprised of at least 90% water (for some applications, at least 98% water) and balance acids along a first diverging conduit 24. The vapor may be utilized for other purposes, including the heat therein, or may be otherwise disposed. The first evaporator 20 may also output a quantity of a second extract through a first conduit 22 to a hydrolysis device 30, although the second extract could be otherwise transported and the first evaporator 20 and the hydrolysis device 30 may be located on separate and remote sites.

The hydrolysis device 30 may receive the second extract from the first evaporator 20 through the first conduit 22, and may output a third extract. The hydrolysis device 30 may receive mineral acid, such as sulfuric or hydrochloric acid, through an acid input conduit 34. The hydrolysis device 30 may strip any sugars that are attached to lignin within the second extract and hydrolyze any oligomers into monomeric sugars. The hydrolysis device 30 may be operated for approximately sixty minutes between an approximate pH of 0 and 2, utilizing mineral acid, and between an approximate temperature of 100° C. and 120° C. The heat of dilution of the addition of mineral acid may be utilized to raise the temperature of the extract to match a temperature required for hydrolysis. The hydrolysis may precipitate a high fraction of the dissolved lignin in the third extract, which may be output along with everything else including sugars through a second conduit 32 to a lignin separation device 40. The second conduit 32 may be valved to allow the hydrolysis device 30 to operate at a higher pressure than the lignin separation device 40, which operates at atmosphere.

The lignin separation device 40 may be located proximate to the hydrolysis device 30 and receive the third extract from the hydrolysis device 30 through the second conduit 32. It is important to separate precipitated lignin from the extract solution because high concentrations of lignin can inhibit the fermentation process for which the monomeric sugars may be used. The lignin separation device 40 may include a chiller, which may simply cool the third extract to a temperature below its previously heated temperature. The lignin separation device 40 may lower the temperature of the third extract such that lignin precipitates, but salt does not. The lignin may precipitate naturally or more easily at the cooled temperature. The precipitated lignin may collect in a lower portion of the lignin separation device 40 and require running a caustic solution, such as black liquor, through the lignin separation device 40 to dissolve and recover the deposited lignin, through conduit 44 which may then be utilized for other purposes or otherwise disposed.

The lignin separation device 40 may feed to a chiller 45 through a third conduit 42. The chiller 45 may further cool the third extract and precipitate some salts, such as sodium sulfate. For example, the chiller 45 may operate at a lower temperature than the lignin separation device 40. A fourth extract may be output from the chiller 45 through a fourth conduit 47. The chiller 45 may precipitate salt, which may collect in a lower portion of the chiller 45 and require running water or other solution to dissolve the salts. The outputted solution may go through conduit 46 to a salt recovery process.

A neutralization device 50 may be included in the system 10, positioned proximately to the chiller 45, as is shown in FIG. 1, to receive the fourth extract through the fourth conduit 47. The neutralization device 50 may receive the fourth extract from the chiller 45 and may neutralize it to a ph value suitable for downstream materials of construction and operation. The neutralization may be done with a neutralizing agent input having a neutralizing agent, such as Ca(OH)2, which is input through a second input conduit 52 and added in the neutralization device 50. When the neutralizing agent is added to the fourth extract, the pH level of the now fifth extract may be raised to between 2 and 5, which may result in the formation of a quantity of solid precipitate. The fifth extract and the quantity of solid precipitate is output from the neutralization device 50 through a fifth conduit 56 to a precipitate removal device 60.

The precipitate removal device 60 may receive the fifth extract from the neutralization device 50 with the quantity of precipitate formed in the neutralization device 50. The precipitate removal device 60 may include a variety of devices, such as a solid/liquid continuous separating unit, which removes the solid precipitate from the fifth extract via conduit 64. The solid precipitate may be comprised of Gypsum CaSO4.A variety of devices, such as a filter press, belt press or a bowl centrifuge may be used as precipitate removal device 60. After removing the solid precipitate from the fifth extract through a fourth diverging conduit 64, the precipitate removal device 60 may output the fifth extract, as a quantity of concentrated extract with solid precipitate removed, through a sixth conduit 62. Vapors produced from other parts of the system 10 may run proximate to the sixth conduit 62 to begin heating the fifth extract prior to its deposition in a second evaporator 70.

The second evaporator 70 may receive the fifth extract from precipitate removal device 60 through the sixth conduit 62. The second evaporator 70 may be operated between a pH 2 and 4 between a concentration factor of 3-7×. A high percentage of the volatile acids may be recovered in the vapor of the second evaporator 70 as the fifth extract is further evaporated. When condensed, the vapor may be suitable for feedstock to a number of different acid recovery systems. Accordingly, the second evaporator 70 may receive the fifth extract from the precipitate removal device 60 and may remove a quantity of acetic acid, a quantity of formic acid, and other volatile materials from the fifth extract in a vapor from through a fifth diverging conduit 74, which may then be recovered. The acetic and formic acids may be utilized in an acetic acid upgrading part of the system 10 (not discussed herein). The second evaporator 70 may output a quantity of vapor having the quantity of acetic acid, such as 30-80 g/l of acetic acid, and a quantity of formic acid. In some cases, the output quantity of vapor may include 40-50 g/l of acetic acid and 10-30 g/l of formic acid. Additionally, the second evaporator 70 may output a sixth extract, which may be fed to a third evaporator 80 through the seventh conduit 72.

The third evaporator 80, which receives the sixth extract from the second evaporator 70, may be operated between a pH 2 and 4. The third evaporator 80 may be operated in dilution mode to remove any residual acetic and formic acid within the sixth extract that was not removed in the second evaporator 70. In dilution mode, a water supply through a third input conduit 84 adds water concurrent with vaporization in the third evaporator 80, providing additional vapor to enhance acid removal. Additionally, the system 10 may provide for the recycling of volatile acids and other volatile components to earlier evaporation processes by removing the residual acetic and formic acid through the feedback feed 16 to the first evaporator. The third evaporator may operate at a concentration factor of 1-2×. The diluted acid vapor is not fit for resale and may be discarded, but may also be recycled back into the system 10, and to the first evaporator 20 through conduit 86. This will increase acid output from the second evaporator 70, increasing the recovery of the volatile components in the system 10. The third evaporator 80 may output a quantity of vapor having the quantity of acetic acid, such as 1-10 g/l of acetic acid, and the quantity of formic acid to the first evaporator 20. The quantity of acid vapor that is output in vapor form may also be output in a mixed vapor and liquid form. Additionally, the third evaporator 80 may output a seventh extract through an eighth conduit 82. Inclusion of the third evaporator 80 is optional, since the sixth extract of the second evaporator 70 may be sent to the desalination device 90 directly. However, the system 10 may experience degradation of process without the third evaporator 80.

A desalination device 90 may be located proximate to an output 92 of the system 10, and may receive the seventh extract from the third evaporator 80 through the eighth conduit 82. The desalination device 90 may reduce the salt, heavy metals, lignin, and/or residual acid within the non-concentrated extract to further polish and refine the extract. The desalination device 90 may assist with reducing acid concentration within the seventh extract that has not been removed in the previous devices. The desalination device 90 may output an acid rich, heavy metal rich, lignin rich, and salt-rich liquid solution and a desalinated solution with conduit 94, which may be discarded or fed to a fermentation processing device.

Figure 2:
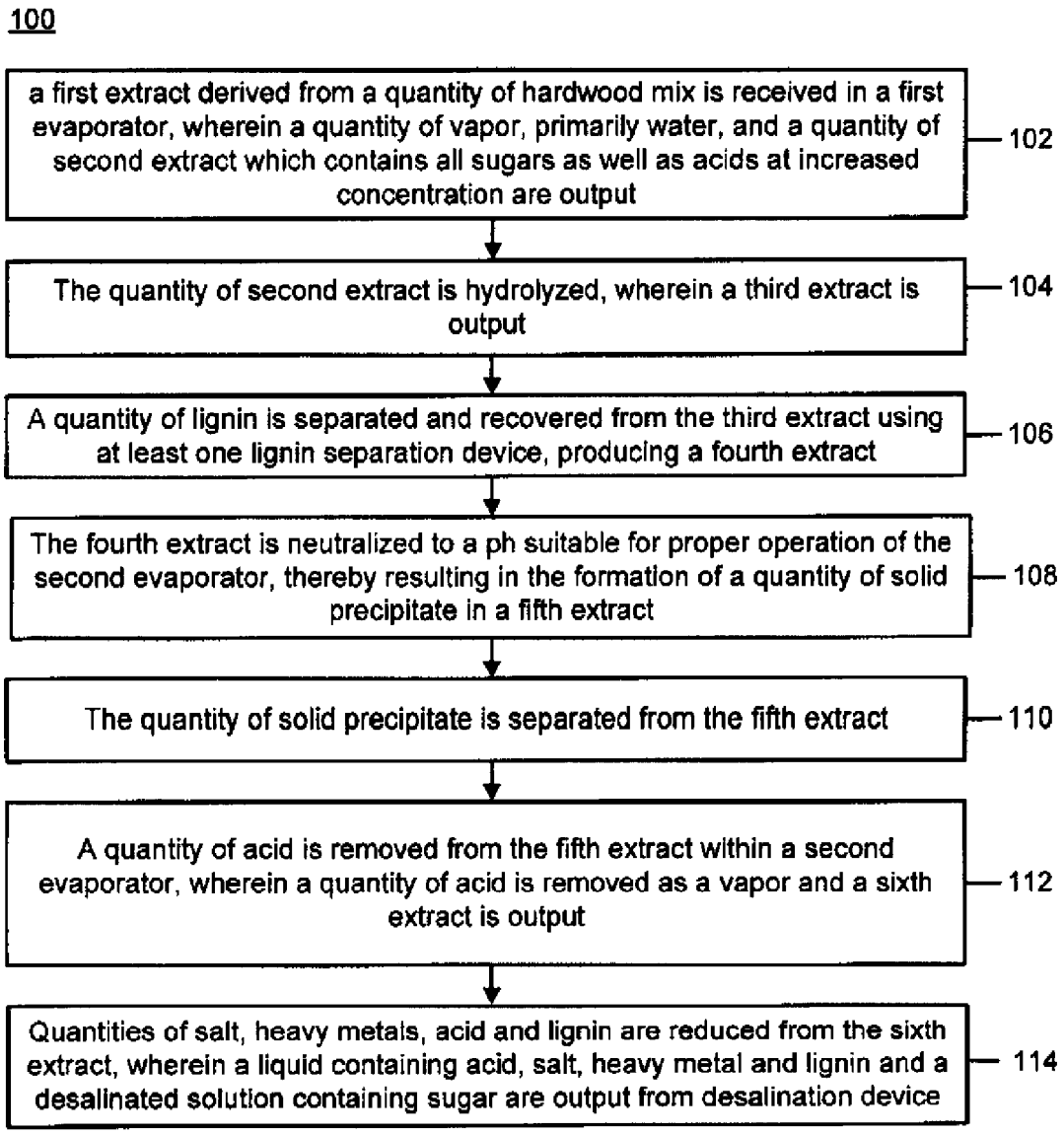
FIG. 2 is a flowchart illustrating a continuous hardwood raw liquid extraction, in accordance with the first exemplary embodiment of the present disclosure.

FIG. 2 is a flowchart 100 illustrating a method of conditioning hardwood pulp liquid hydrolysate, in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a first extract derived from a quantity of hardwood mix is received in a first evaporator, wherein a quantity of vapor, primarily water, and a quantity of second extract which contains all sugars as well as acids at increased concentration are output. The quantity of second extract is hydrolyzed, wherein a third extract is output (block 104). A quantity of lignin is separated and recovered from the third extract using at least one lignin separation device, producing a fourth extract (block 106). The fourth extract is neutralized to a ph suitable for proper operation of the second evaporator, thereby resulting in the formation of a quantity of solid precipitate in a fifth extract (block 108). The quantity of solid precipitate is separated from the fifth extract (block 110). A quantity of acid is removed from the fifth extract within a second evaporator, wherein a quantity of acid is removed as a vapor and a sixth extract is output (block 112). Quantities of salt, heavy metals, acid and lignin are reduced from the sixth extract, wherein a liquid containing acid, salt, heavy metal and lignin and a desalinated solution containing sugar are output from desalination device (block 114).

Figure 3:
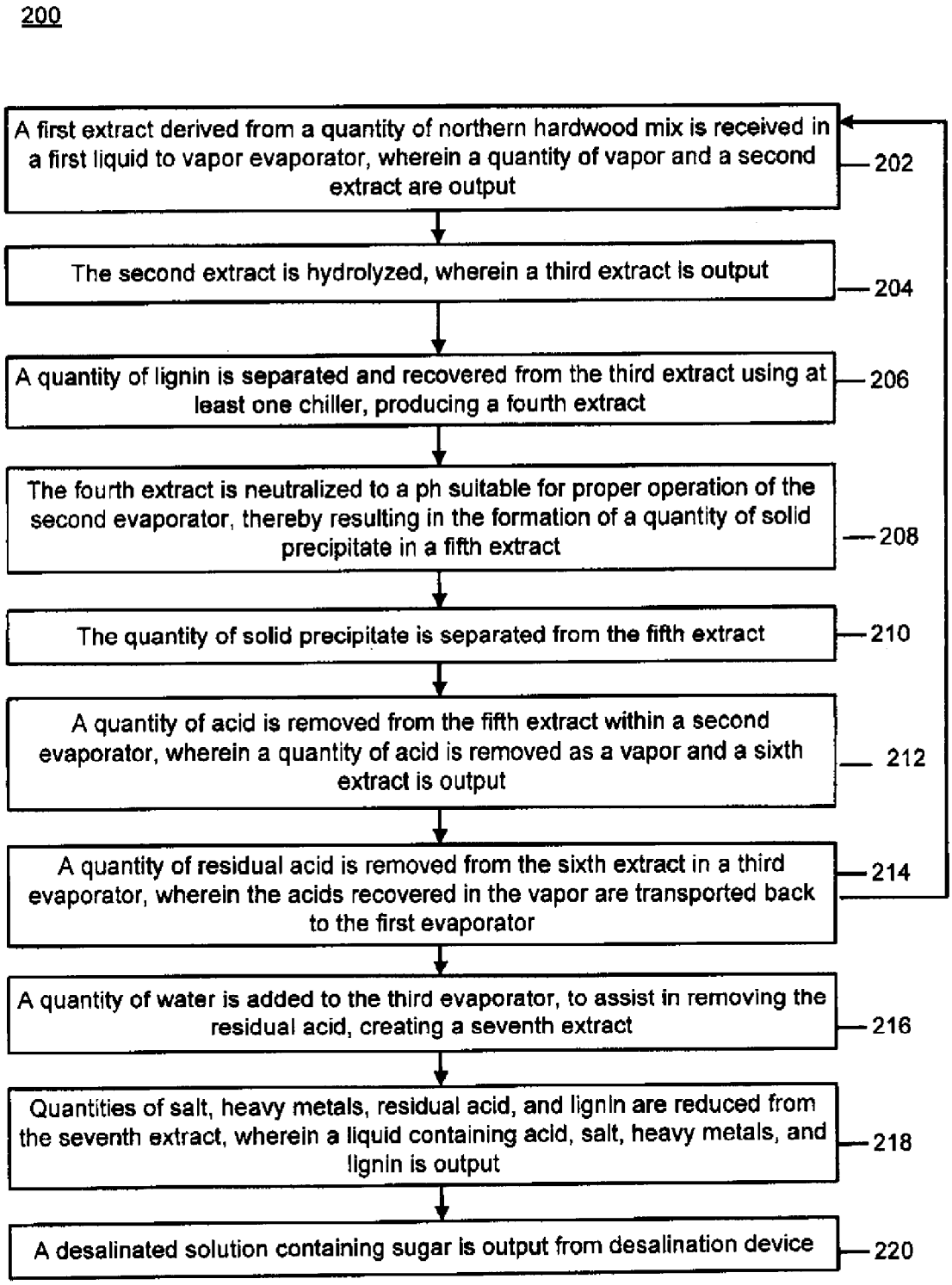
FIG. 3 is a flowchart illustrating a continuous hardwood raw liquid extraction, in accordance with the first exemplary embodiment of the present disclosure.

FIG. 3 is a flowchart 200 illustrating a continuous hardwood raw liquid extraction, in accordance with the first exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, a first extract derived from a quantity of hardwood mix is received in a first evaporator, wherein a quantity of vapor, primarily water, and a quantity of second extract which contains all sugars as well as acids at increased concentration are output. The quantity of second extract is hydrolyzed, wherein a third extract is output (block 204). A quantity of lignin is separated and recovered from the third extract using at least one chiller, producing a fourth extract (block 206). The fourth extract is neutralized to a ph suitable for proper operation of the second evaporator, thereby resulting in the formation of a quantity of solid precipitate in a fifth extract (block 208). The quantity of solid precipitate is separated from the fifth extract (block 210). A quantity of acid is removed from the fifth extract within a second evaporator, wherein a quantity of acid is removed as a vapor and a sixth extract is output (block 212). A quantity of residual acid is removed from the sixth extract in a third evaporator, wherein the acids recovered in the vapor are transported back to the first evaporator (block 214). A quantity of water is added to the third evaporator, to assist in removing the residual acid, creating a seventh extract (block 216). Quantities of salt, heavy metals, residual acid, and lignin are reduced from the seventh extract, wherein a liquid containing acid, salt, heavy metals, and lignin is output (block 218) A desalinated solution containing sugar is output from desalination device as well (block 220).

Many additional steps and variations may also be included with the methods described herein, including any variations, conditions, or additional steps that are disclosed with respect to FIG. 1. For example, the first evaporator may be operated between a pH 6 and 8. The second extract may hydrolyzed for substantially sixty minutes between an approximate pH of 0 and 2 and between an approximate temperature of 100° C. and 120° C. The fourth extract may be neutralized to have a pH between 2 and 5. The quantity of acid removed may include a quantity of acetic acid and a quantity of formic acid, which are removed from the fifth extract within the second evaporator operated between a pH of 2 and 4. Accordingly, the quantity of vapor having the quantity of acetic acid and the quantity of formic acid, and a sixth extract may be output. Similarly, the quantity of residual acid may include a quantity of residual acetic acid and a quantity of residual formic acid, which may be removed from the sixth extract in a third evaporator operated between a pH of 2 and 4. A quantity of water is added to the third evaporator to enhance acid removal. The quantity of vapor having the quantity of acetic acid, the quantity of formic acid and a quantity of water, is output as well and recycled to the first evaporator. The seventh extract is also produced and sent to a desalination device, which removes salts, heavy metals, residual acids and lignin. The eighth stream is outputted from the desalination device and sent to fermentation or further processing. The entire process may be configured to operate continuously or it may be operated as a batch system. Any additional steps or variations not explicitly discussed may also be included with the method, all of which are considered within the scope of the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure and the present disclosure and protected by the following claims.

What is claimed is:

1. A hardwood pulp liquid hydrolysate conditioning system comprising:

a first evaporator receiving a first extract derived from a quantity of hardwood mix and outputting a first quantity of vapor and a second extract;

a hydrolysis unit positioned to receive the second extract and output a third extract;

at least one lignin separation device positioned to receive the third extract from the hydrolysis unit, wherein the at least one lignin separation device separates and recovers a quantity of lignin from the third extract and outputs a fourth extract;

a neutralization device positioned to receive a fourth extract, the neutralization device having a neutralizing agent input, wherein the neutralization device adjusts a pH of the fourth extract to form a quantity of solid precipitate and a fifth extract;

a precipitate removal device positioned to receive the quantity of solid precipitate and the fifth extract from the neutralization device, wherein the precipitate removal device separates the quantity of solid precipitate from the fifth extract;

a second evaporator positioned to receive the fifth extract from the precipitate removal device, wherein the second evaporator removes a first quantity of acid from the fifth extract, wherein the second evaporator outputs a second quantity of vapor having the first quantity of acid, and wherein the second evaporator outputs a sixth extract; and a desalination device, positioned to receive the sixth extract, wherein the desalination device removes a quantity of salt, heavy metal, residual acid, and lignin from the sixth extract and outputs a seventh extract comprising a desalinated solution containing sugar.

2. The hardwood pulp liquid hydrolysate conditioning system of claim 1, wherein the first evaporator is operated at a pH between 6 and 8.

3. The hardwood pulp liquid hydrolysate conditioning system of claim 1, wherein the hydrolysis unit is operated for substantially sixty minutes.

4. The hardwood pulp liquid hydrolysate conditioning system of claim 1, wherein the hydrolysis unit is operated between an approximate pH of 0 and 2.

5. The hardwood pulp liquid hydrolysate conditioning system of claim 1, wherein the hydrolysis unit is operated at an approximate temperature between 100° C. and 120° C.

6. The hardwood pulp liquid hydrolysate conditioning system of claim 1, wherein the at least one lignin separation device further comprises a first chiller.

7. The hardwood pulp liquid hydrolysate conditioning system of claim 6, wherein the at least one lignin separation device further comprises a second chiller that operates at a lower temperature than the first chiller, wherein the second chiller precipitates salt.

8. The hardwood pulp liquid hydrolysate conditioning system of claim 1, wherein the neutralization device adjusts the fourth extract to have a pH between 2 and 5.

9. The hardwood pulp liquid hydrolysate conditioning system of claim 1, wherein the second evaporator is operated between a pH of 2 and 4.

10. The hardwood pulp liquid hydrolysate conditioning system of claim 1, wherein the first quantity of acid further comprises a first quantity of acetic acid and a first quantity of formic acid.

11. The hardwood pulp liquid hydrolysate conditioning system of claim 1, further comprising a third evaporator positioned to receive the sixth extract, wherein the third evaporator removes a second quantity of acid from the sixth extract while adding a quantity of water to the sixth extract, and outputs the second quantity of acid to the first evaporator.

12. The hardwood pulp liquid hydrolysate conditioning system of claim 11, wherein the third evaporator is operated in dilution mode.

13. The hardwood pulp liquid hydrolysate conditioning system of claim 11, wherein the removed second quantity of acid includes a quantity of inorganic and organic acids.

14. The system of claim 11, further comprising recovering the second quantity of acid from the third evaporator.

15. The system of claim 1, wherein the first quantity of acid is recovered from the second quantity of vapor.

* * * * *